US010219612B2

(12) United States Patent
Urfer et al.

(10) Patent No.: US 10,219,612 B2
(45) Date of Patent: Mar. 5, 2019

(54) BRUSHING DEVICE FOR THE WORKING OF WORKPIECES

(71) Applicant: Liechti Engineering AG, Langnau i.E. (CH)

(72) Inventors: Christoph Urfer, Thun (CH); Andreas Scheidegger, Konolfingen (CH); Ernst Haueter, Bowil (CH)

(73) Assignee: Liechti Engineering AG (CH)

( * ) Notice: Subject to any disclaimer, the term of this patent is extended or adjusted under 35 U.S.C. 154(b) by 9 days.

(21) Appl. No.: 15/584,428

(22) Filed: May 2, 2017

(65) Prior Publication Data

US 2017/0318949 A1 Nov. 9, 2017

(30) Foreign Application Priority Data

May 3, 2016 (EP) ..... 16168107

(51) Int. Cl.

| | |
|---|---|
| ***A44B 9/10*** | (2006.01) |
| ***A46B 9/10*** | (2006.01) |
| ***A46B 13/02*** | (2006.01) |
| ***A46B 17/04*** | (2006.01) |
| ***B24D 13/14*** | (2006.01) |

(52) U.S. Cl.

CPC ..... *A46B 9/10* (2013.01); *A46B 13/02* (2013.01); *A46B 17/04* (2013.01); *B24D 13/145* (2013.01); *A46B 2200/3073* (2013.01); *A46B 2200/3086* (2013.01)

(58) Field of Classification Search

CPC ... A46B 9/10; A46B 13/02; A46B 2200/3086; A46B 2200/3073

USPC ..... 451/463, 464–469, 59

See application file for complete search history.

(56) References Cited

U.S. PATENT DOCUMENTS 3,678,529 A * 7/1972 Woods ..... A46B 9/10 15/169
3,780,407 A * 12/1973 Hoffecker ..... A46B 7/08 15/169
6,142,868 A * 11/2000 Pfanstiehl ..... A46B 11/001 15/169

(Continued)

FOREIGN PATENT DOCUMENTS

EP 2522461 A1 11/2012
JP S56146020 U 11/1981

(Continued)

OTHER PUBLICATIONS

Extended European Search Report (in Germany) received Nov. 28, 2016 regarding corresponding EP Application No. 16168107.7 (7 pages).

*Primary Examiner* — Robert Rose

(74) *Attorney, Agent, or Firm* — Harness, Dickey & Pierce, P.L.C.

(57) ABSTRACT

The brushing device contains a bundle of fiber rods (1), which are arranged parallel to one another, and a protective sleeve (2), which encloses the fiber rods. Once fiber rods (1) have become worn, the protective sleeve (2) is able to be axially adjusted, so that the free ends of the fiber rods (1) protrude beyond the protective sleeve (2) by a desired amount. A first component (4) connected to the fiber rods (1) and a further, second component (8) connected to the protective sleeve (2) are detachably connected to one another, in a non-positively locking manner, by a clamping mechanism (3, 5, 11).

7 Claims, 1 Drawing Sheet

(56) References Cited

U.S. PATENT DOCUMENTS

| | | | | |
|---|---|---|---|---|
| 2005/0153642 | A1* | 7/2005 | Matsushita ..... | A46B 13/008<br>451/526 |
| 2017/0028522 | A1 | 2/2017 | Scheidegger et al. | |

FOREIGN PATENT DOCUMENTS

| | | | |
|---|---|---|---|
| JP | 2005-111640 | A | 4/2005 |
| WO | WO-2015/178273 | A1 | 11/2015 |

* cited by examiner

BRUSHING DEVICE FOR THE WORKING OF WORKPIECES

CROSS-REFERENCE TO RELATED APPLICATIONS

This application claims the benefit and priority of EP 16168107.7, filed May 3, 2016. The entire disclosure of the above application is incorporated herein by reference.

FIELD

The invention relates to a brushing device for the working of workpieces, containing a bundle of fibre rods, which are arranged parallel to one another, and a protective sleeve, which encloses the fibre rods and is axially adjustable relative to the fibre rods.

BACKGROUND

Brushing devices of this kind are used, in particular, on machine tools in order to grind, polish or clean the surfaces of workpieces and to deburr or round off the edges of workpieces. The fibre rods, which can consist, for instance, of a ceramic material, are subjected to wear and tear during the said working operations. The extent by which the free ends of the fibre rods protrude beyond the protective sleeve must therefore be periodically readjusted. In known brushing devices, a holder carrying the fibre rods has a locking screw, which juts through a longitudinal slot in the protective sleeve. For the readjustment of the said extent, the locking screw is loosened, the protective sleeve axially displaced by an amount, and the locking screws then tightened again. This requires for each readjustment operation manual interventions, which are associated with a stoppage of the machine.

Document WO2015/178273A1 describes a brushing device with mechanical readjustment of the relative position of the protective sleeve and of the fibre rods. This is enabled by a nut-spindle combination, which is connected to the fibre rods and the protective sleeve. For the readjustment, the nut and the spindle must be rotated relative to one another, which is achieved by a relatively complex design of the brushing device, which design, moreover, makes the use of a standard tool holding fixture for the brushing device practically impossible.

SUMMARY

Starting from this prior art, an aspect of the invention is to eliminate the drawbacks of the known prior art and to propose a brushing device which is of simple construction and easy to operate and makes do without parts which are rotatable relative to one another.

The clamping mechanism allows the non-positive connection to be removed and the adjustment to be conducted in simple manner.

DRAWINGS

Figure 1:
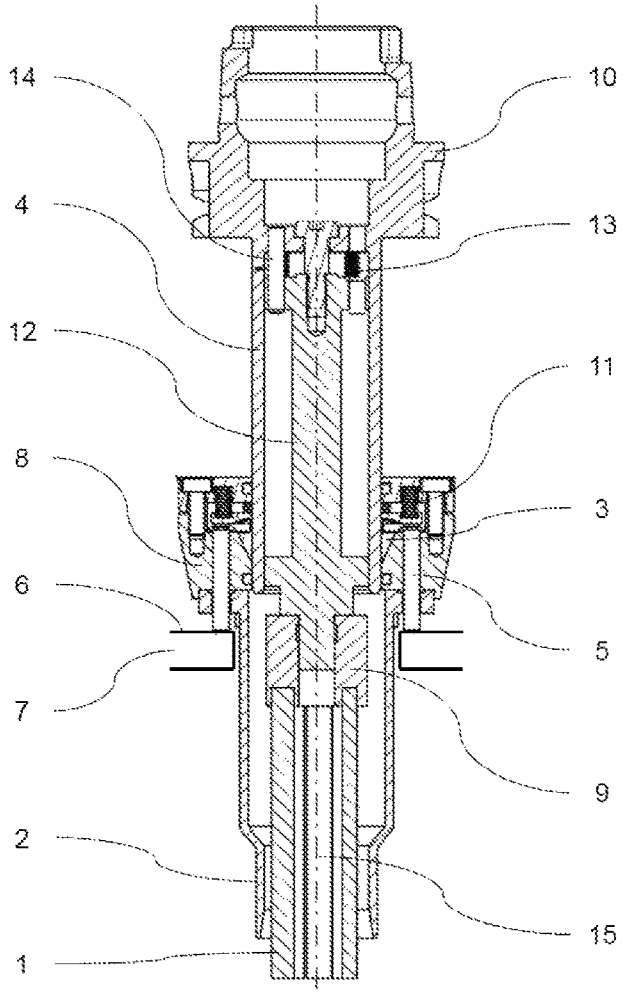
Figure 2:
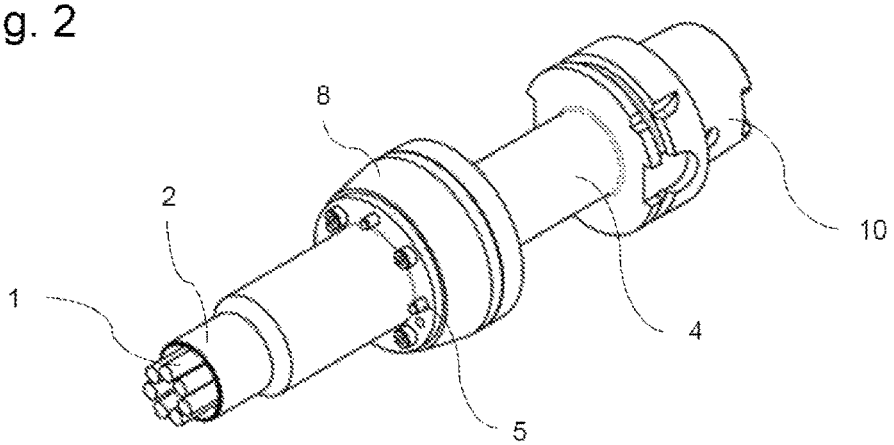

An illustrative embodiment of the invention is explained below with reference to the appended drawings, in which FIG. 1 shows a longitudinal section through a brushing device according to the invention, and FIG. 2 shows a perspective view of the brushing device according to FIG. 1 on a scale which is reduced in relation to FIG. 1.

DESCRIPTION OF THE PREFERRED EMBODIMENTS

The brushing device comprises a bundle of fibre rods 1, which is anchored in a holder 9. The fibre rods 1 are here enclosed by a protective sleeve 2, wherein their free ends protrude by an amount from the protective sleeve 2. The holder 9 is connected to a shaft 12, which for its part is surrounded by a guide tube 4. At the end opposite the fibre rods, the brushing device is connected to a standard tool holding fixture 10 of the HSK (hollow shank taper) type. For the transmission of the torque from the tool holding fixture 10 to the holder 9 containing the fibre rods 1, pins 14 are present, which, when an axial load is applied to the fibre rods 1, allow these to yield counter to the force of springs 13. At that end which is facing away from the exposed ends of the fibre rods 1, the protective sleeve 2 is connected to a housing 8, in which is accommodated a clamping cone 3 which is axially adjustable counter to the force of springs 11 and connects the protective sleeve 2 non-positively to the guide tube 4. The clamping cone 3 is here advantageously divided into, for instance, four segments, which are arranged around the guide tube 4.

For the working of a surface of a workpiece, for instance a turbine blade, the brushing device is clamped in a tool axis of a machine tool and rotated about its longitudinal axis 15. Upon the contact with the workpiece, the fibre rods 1 are subject to wear, which from time to time is compensated by increasing up to a desired amount the extent by which the fibre rods 1 protrude beyond the protective sleeve. For this purpose, the tool axis with the brushing device is moved relative to a fixed counter bearing 7 and advanced in the direction of the longitudinal axis until pressure bolts 5 present on the brushing device come to bear against a locating surface 6 of the counter bearing. The clamping cone 3 in contact with the pressure bolts 5 is thus prevented from continuing to follow the axial movement of the tool axis. Upon the further advancement of the tool axis, the housing 8, together with the protective sleeve 2, follows this movement still by a small amount, wherein the housing 8 shifts relative to the clamping cone 3, thereby reduces the clamping force thereof and thus loosens the non-positive connection between the guide tube 4 and the housing 8 with the protective sleeve 2 arranged thereon. The combination of tool holding fixture 10, guide tube 4, shaft 12, holder 9 and fibre rods 1 can now further follow the axial movement of the tool axis, whereby the distance between the free ends of the fibre rods 1 and the free end of the protective sleeve 2 increases.

When the tool axis is moved back, the pressure bolts 5 are relieved of load and the springs 11 press the clamping cone 3 into its clamping position, in which it prevents an axial displacement of the guide tube 4 in the protective sleeve 4.

The amount by which the free ends of the fibre rods 1 protrude beyond the free end of the protective sleeve 2 can be determined in a simple manner by a measuring device, for instance a laser measuring device, present on the machine tool. As soon as this amount falls below a predefined value, the described readjustment is initiated.

REFERENCE SYMBOL LIST

1 fibre rods
2 protective sleeve
3 clamping cone
4 guide tube
5 pressure bolts

6 locating surface
7 counter bearing
8 housing
9 holder
10 tool holding fixture
11 clamping spring
12 shaft
13 spring
14 pin
15 longitudinal axis

What is claimed is:

1. Brushing device for the working of workpieces, comprising a bundle of fibre rods, arranged parallel to one another, and a protective sleeve, which encloses the fibre rods and is axially adjustable relative to the fibre rods, wherein the brushing device has a clamping mechanism, which detachably connects to one another, in a non-positively locking manner, a first component connected to the fibre rods and a second component connected to the protective sleeve;

wherein the clamping mechanism contains a clamping cone.

2. The brushing device according to claim 1, further comprising at least one spring that forces the clamping cone into a position in which it connects the first component and the second component to one another in a non-positively locking manner.

3. The brushing device according to claim 1, further comprising at least one pressure bolt which is in contact with the clamping cone.

4. The brushing device according to claim 3, wherein the at least one pressure bolt is oriented parallel to the fibre rods.

5. The brushing device according to claim 3, wherein the first component is a guide tube which is connected to a tool holding fixture and surrounds a shaft bearing the fibre rods.

6. The brushing device according to claim 3, wherein the second component is a housing accommodating the clamping mechanism.

7. The brushing device according to claim 3, wherein the bundle of fibre rods is arranged so as to be axially pliable counter to the force of a second spring.

* * * * *